US005569871A

United States Patent [19]

Wheaton et al.

[11] Patent Number: 5,569,871

[45] Date of Patent: Oct. 29, 1996

[54] MUSICAL TONE GENERATING APPARATUS EMPLOYING MICRORESONATOR ARRAY

[75] Inventors: James A. Wheaton, Fairfax; Erling Wold, El Cerrito; John Strawn, Larkspur; Steven Warwick, Santa Rosa, all of Calif.

[73] Assignee: Yamaha Corporation, Japan

[21] Appl. No.: 259,543

[22] Filed: Jun. 14, 1994

[51] Int. Cl.[6] ..... G10H 1/08; G10H 3/00; G10H 7/00

[52] U.S. Cl. ..... 84/625; 84/698; 84/718

[58] Field of Search ..... 84/600, 671, 675–711, 84/718, DIG. 24; 368/10, 159, 255, 281

[56] References Cited

U.S. PATENT DOCUMENTS 4,278,000 7/1981 Saito et al. ..... 84/DIG. 24
4,378,721 4/1983 Kaneko et al. ..... 84/DIG. 24
4,918,674 4/1990 Shimozono et al. ..... 368/255
5,361,241 11/1994 Ferrara et al. ..... 368/281
5,420,570 5/1995 Leitten et al. ..... 368/10 X

*Primary Examiner*—Stanley J. Witkowski
*Attorney, Agent, or Firm*—Graham & James LLP

[57] ABSTRACT

A musical tone generating apparatus employs an array of microresonant structures to generate the harmonic component signals of a musical tone to be generated. The microresonant structures produce high frequency signals which are down converted to audio frequency range by mixing them with a high frequency reference signal. The desired tone color is achieved by modifying the relative amplitudes of the harmonic component signals to produce a desired tone color. A large number of microresonators are preferably integrated on a single integrated circuit substrate to provide a variable tone generating system in a relatively compact environment.

19 Claims, 5 Drawing Sheets

MUSICAL TONE GENERATING APPARATUS EMPLOYING MICRORESONATOR ARRAY

BACKGROUND OF THE INVENTION

The present invention relates to musical tone generating systems. More particularly, the present invention relates to analog and digital electric and electronic musical instruments.

DESCRIPTION OF THE PRIOR ART AND RELATED INFORMATION

A wide variety of different electric and electronic systems have been employed to generate musical tones. Electric musical tone generation systems are essentially conventional acoustic musical instruments coupled to an electrical pickup mechanism which converts the vibrations of the acoustical musical instrument to electrical signals for amplification. For example, electric pianos, electric guitars, electric violins, etc. are all well known examples of this form of musical tone generation system. This type of tone generation system, however, is confined to amplification of natural musical instruments and cannot provide the variety of tone colors, tone pitches, and various other effects which may be provided by more advanced electronic tone generation systems. Electronic musical instruments have been implemented in a number of different forms. The earliest electronic musical instruments were analog in nature, using one or more analog tone generators, such as voltage controlled oscillators (VCOs), which generate sine waves which were provided with a tone color through crude manual summation of harmonics. Also, sawtooth wave, square wave, etc. analog outputs have been employed to generate tones of different tone colors. Later, analog signals were provided with various tone colors by virtue of filtering systems. Analog electronic musical instruments have been generally replaced in the marketplace by digital electronic instruments, however. In particular, the greater capabilities of the digital systems to impart effects and provide flexible user control over tone color, and other characteristics, and the inherent limitations of using VCOs or like analog tone generators for creating complex wave forms, have, to a large extent, rendered analog electronic tone generation systems obsolete.

Digital electronic musical instruments have been developed with a variety of different tone generation systems employed therein. For example, the sample points of a single period of a sine wave may be stored in a digital memory and repetitively read out at different readout rates to generate basic tones at different pitches. A more complex version of this type of system employs a single period of a waveshape, including the various harmonics, such that when it is repetitively read out, a musical tone having a more natural sounding tone color is provided. Additionally, a variety of other tone generation systems are known, employing memory readout, digital filtering or FM modulation to provide varying tone colors.

Despite the considerable variety of available electronic musical instruments employing digital tone generation, each of them has one or more limitations. For example, memory read out type digital electronic musical instruments are limited by the capacity and cost of commercially available high speed semiconductor memory devices, which must be rapidly accessed and read out to generate the musical tone. This limits the complexity, and/or tone color variety, of the musical tones to be generated for instruments of reasonable cost. Further, systems such as FM tone generation, which have the ability to provide complex waveforms without requiring large memories, suffer from the lack of ability to very accurately reproduce the sounds of natural musical instruments.

Accordingly, it will be appreciated that all of the currently known electric and electronic musical instrument tone generation systems suffer from one or more disadvantages. Accordingly, a need presently exists for a tone generating system capable of reproducing natural musical sounds with high fidelity and without employing large memories or extremely complex circuitry.

SUMMARY OF THE INVENTION

The present invention provides an analog tone generating apparatus, which can provide musical tones having a great deal of complexity without requiring large amounts of memory or other complex circuitry.

In a preferred embodiment, the present invention provides a tone generating apparatus which employs a large number of microresonators integrated on a silicon substrate. These microresonators provide well-defined physical vibrations in response to activation of a pitch designation interface, for example, a keyboard. The microresonators are tuned to specified frequencies, e.g., by adjusting the size of the resonating structures therein or by electrically controlling the frequency. The vibrations of the microresonators are converted to electrical signals; for example, an electrostatic/capacitive coupling between the resonating structure and electrical contacts may be employed. Where the microresonator frequencies are very high relative to the audio range, high frequency electrical signals from the microresonators are mixed with a high frequency reference signal to convert the high frequency signals to an audio frequency range. The output signals are then summed together to create a musical tone control signal having a plurality of harmonics defined by the microresonators activated. The output tone control signal is then provided to an envelope generator which imparts an envelope to the tone control signal prior to its being provided to a conventional tone output system, such as a speaker. Alternatively, envelope control may be integrated into the microresonators by incorporating a damping mechanism therein.

The present invention, further, provides a variable tone color capability by employing a tone color control system which controls weighting factors for each of the resonators. Upon selection of a tone color by the user of the tone generating apparatus, the corresponding harmonic weighting factors are output from the tone color control circuitry and are used to control the amplitude of the respective plural frequency signals generated by the microresonators. For example, the harmonic coefficient signals may be provided to voltage controlled amplifiers, which also receive the output from the microresonators, to thereby control the microresonator output signal in accordance with the desired harmonic content.

A large number of microresonators, for example, several hundred or more, may be provided on a single integrated circuit chip or on a number of such chips. Individual microresonators may thus be provided for each harmonic comprising each tone of an acoustic instrument if desired. In this way, existing analog musical instruments may be simulated more accurately. For example, by providing a microresonator for each string of a piano, an effective simulation of the complex tone structure of an acoustic piano may be provided.

Accordingly, it will be appreciated that the present invention allows a complex natural tone to be built up through summation of harmonics by virtue of the use of a large number of microresonators providing essentially instantaneous sine wave component signals as desired. Furthermore, the combination of tone color control circuitry and micromechanical analog sine wave generation circuitry provides considerable variety in both tone color and tone quality while avoiding complex circuitry or requiring extremely large memories. Further features and advantages of the present invention will be appreciated by those skilled in the art from review of the following detailed description of the invention.

DETAILED DESCRIPTION OF THE INVENTION

Figure 1:
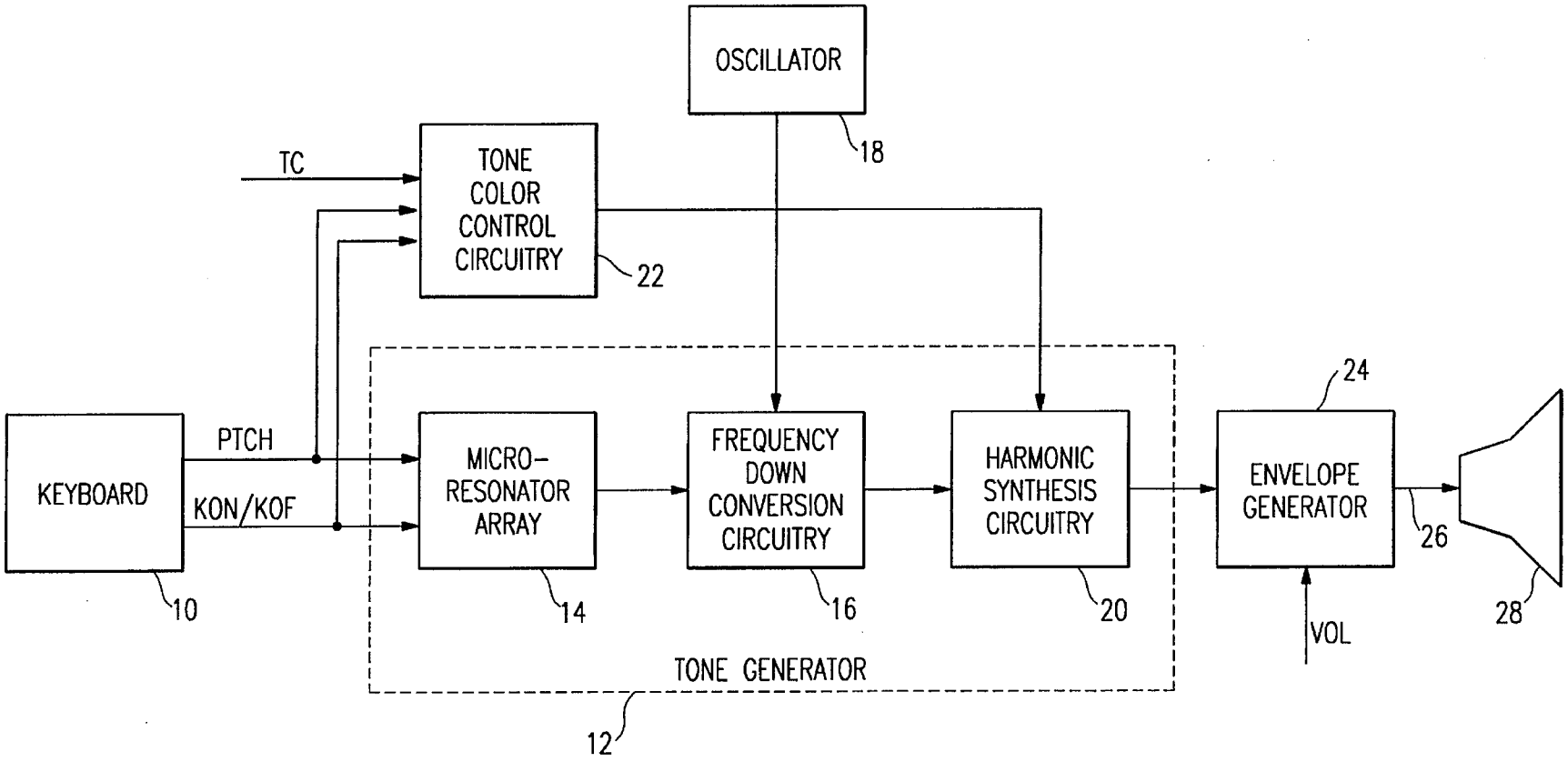
FIG. 1 is a block schematic drawing of a preferred embodiment of the musical tone generating apparatus of the present invention.

Referring to FIG. 1, the basic components of the tone generating apparatus of the present invention are illustrated in a block schematic drawing.

The present invention includes a tone pitch input interface 10, shown as a keyboard in FIG. 1. It will be appreciated that various other tone pitch input devices may also be employed; for example, fingering type controllers may be employed for an interface 10 which is breath activated, or a string-type input may be employed for interface 10 to emulate a string-based natural musical instrument. Keyboard 10 provides a key on signal (KON) and key off signal (KOF) in response to activation of a key and release thereof, respectively, and a pitch designation signal (PTCH) designating the pitch of the key activated by the performer. Alternatively, as will be described in more detail below, the individual keys of keyboard 10 may be "hard wired" to matching arrays of microresonators, to provide the fundamental tone and harmonics thereof in a fixed manner for each key. In this case, the pitch designation signal (PTCH) and the key on and key off signals (KON and KOF) may be dispensed with and the activation of the various keys on the keyboard serve to close a switch to the appropriate microresonator subarray.

Still referring to FIG. 1, the signals from the keyboard 10 designating the initiation of a tone (KON) and the pitch of the tone (PTCH) are provided to tone generator 12. As illustrated, tone generator 12 includes a microresonator array 14 which includes a relatively large number of micromachined resonant structures which may be formed on a single monolithic integrated circuit substrate or on a plurality of such integrated circuit substrates. Microresonator array 14 provides a number of high frequency output signals in response to the key on signal. More particularly, in response to a key on signal, provided from keyboard 10, the microresonator array 14 will output a first high frequency signal corresponding to the fundamental of the tone and an additional number of high frequency signals equal in number to the desired number of harmonics to create the desired degree of complexity in the output tone. The specific microresonators activated in the array 14 are determined by the signal PTCH and a microresonator selection circuit, as discussed in more detail below. The frequency of such signals is preferably high enough to prevent coupling of the microresonators to outside vibrations. For example, these high frequency output signals may be in the 75 kHz range and greater in the case of a presently preferred embodiment employing an electrostatically driven mechanical microresonator structure described in more detail below.

The high frequency output signals provided by microresonator array 14 are output to frequency down conversion circuitry 16. Frequency down conversion circuitry 16 shifts the frequency of the signals input thereto down to the audible frequency range by mixing the high frequency signals with a high frequency reference signal $f_c$ which may be provided by a stable reference oscillator 18. For example, when, as noted above, the microresonator output signals are in the 75+ kHz range, the reference signal $f_c$ would be in the same range.

The down converted audio frequency signals from down conversion circuitry 16 are provided to harmonic synthesis circuitry 20. Harmonic synthesis circuitry 20 weights the harmonic signals of the tone to be generated to provide the desired tone color to the output signal. More specifically, harmonic weighting signals are provided from tone color control circuitry 22 which receives a tone color (TC) input signal, provided in response to a tone color selection by the operator of the tone generating apparatus, as well as the pitch selection signal PTCH. The harmonically weighted tone signals are combined and provided from the harmonic synthesis circuit 20. The combined signal is then low pass filtered to remove residual high frequency components and output from tone generator 12.

The output from tone generator 12 is provided to envelope generator 24. Envelope generator 24 may be a conventional analog envelope generator circuit which provides attack, sustain and decay envelopes to the signal output from the tone source generator 12. Additionally, envelope generator 24 may receive a volume control signal (VOL) from a pedal or like tone volume control mechanism operated by the keyboard performer. The envelope generator 24 outputs a musical tone signal on line 26 to tone signal output device 28. As generally indicated in FIG. 1, tone signal output device 28 may be a conventional speaker having amplification circuitry and volume control circuitry associated therewith.

Alternatively, the weighting signals provided from the tone color control circuitry may be time varying. In this case the spectral content of the tone may vary in time and further, envelope generator 24 is not required to modify the signal amplitude over time. However, envelope generator 24 may still be employed to provide an amplitude control in response to a volume control signal.

Figure 2:
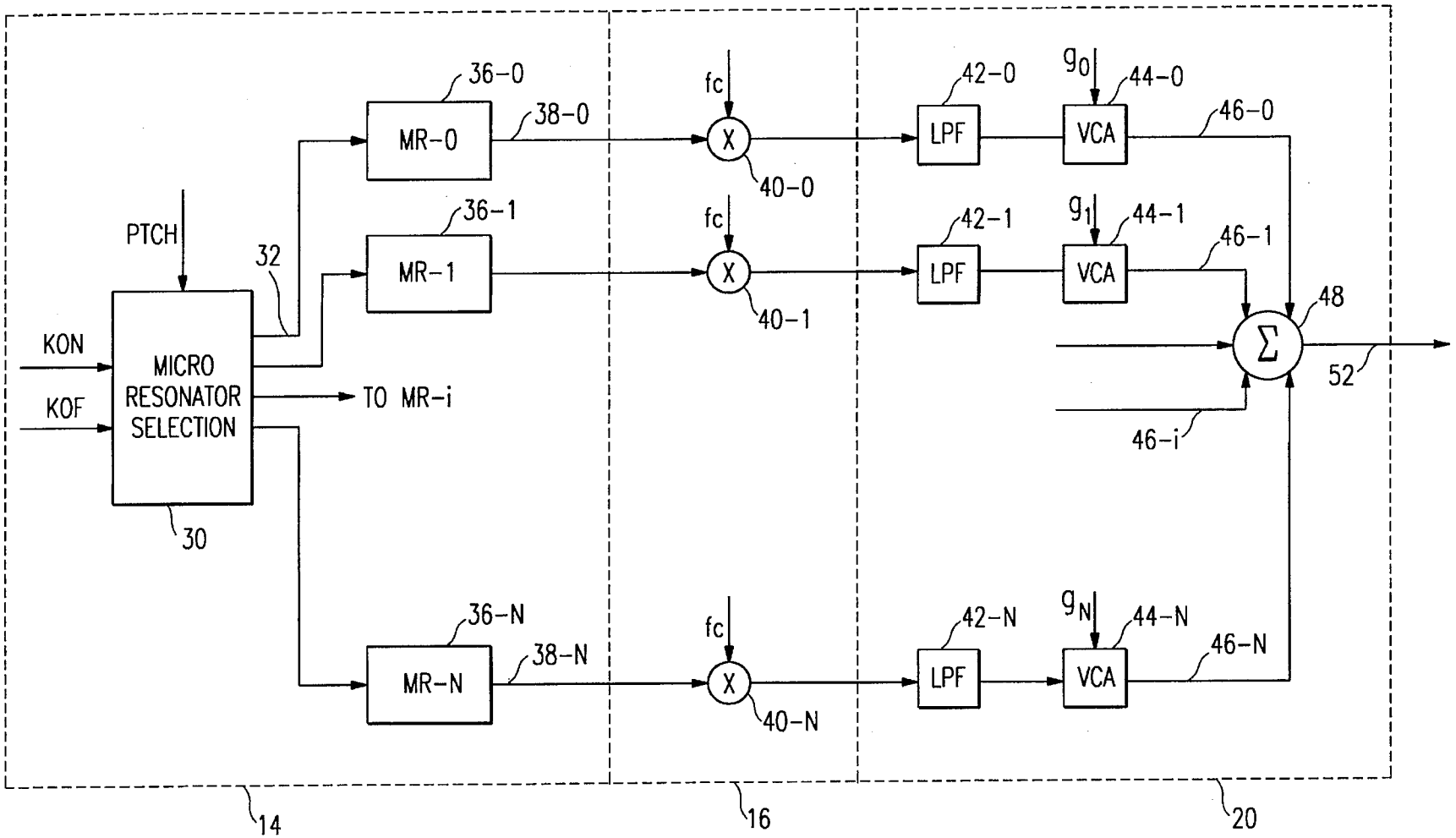
FIG. 2 is a block schematic drawing illustrating a preferred embodiment of the microresonator tone generator employed in the musical tone generating apparatus of the present invention.

Referring to FIG. 2, a preferred embodiment of the tone generator 12 is illustrated. As shown, tone generator 12 receives the pitch designation signal (PTCH) and key on and key off signals (KON and KOF, respectively) from the keyboard. These signals are provided to a microresonator selection circuit 30 which determines the microresonators corresponding to the designated pitch fundamental frequency of the designated tone pitch and a desired number of harmonics thereof. Since the same microresonator employed to generate in one octave, may generate a harmonic for a lower octave, the microresonator selection circuit 30 may take advantage of a reduced number of microresonators from a full complement of n×m (where n is the number of desired harmonics for each note and m is the number of keys on the keyboard or other tone pitch selection device).

As shown in FIG. 2, the microresonator selection circuit 30 provides microresonator drive signals along lines 32 to selected microresonators in microresonator array 14. Microresonator array 14 employs a large number of micromachined resonating structures to be described in more detail below. These may preferably be integrated on a single monolithic chip of polysilicon or other material suitable for microfabrication using photolithography and etching techniques known in the art.

As illustrated in FIG. 2 by the number of microresonators shown, a key on signal (KON) will cause N+1 microresonators 36-0–36-N to be actuated. More specifically, N+1 microresonators 36-0 to 36-N, corresponding to the N+1 harmonics necessary to give the desired tone color and richness to the note designated by the keyboard, will be activated. For example, in the case where 10 harmonics are employed, each key activation will cause 10 microresonators to be activated. The total number of microresonators in the array 14, in turn, will be a number sufficient to create all the desired harmonics for the desired tones; for example, two hundred or more microresonators may preferably be employed.

Still referring to FIG. 2, the microresonators selected by the microresonator selection circuit 30 provide output high frequency signals along lines 38-0–38-N. The output frequency of these selected microresonators will be tuned so as to be shifted by the desired frequency of the tone pitch from a high frequency carrier frequency $f_c$. For example, if the selected tone pitch is $A_4$ which has a frequency of 440 Hz, and the reference frequency is selected at 100 kHz, the fundamental microresonator 36-0 would be tuned to provide an output frequency of 100,440 Hz. The microresonator corresponding to the first overtone, in turn, would provide an output frequency of 100,880 Hz, whereas the microresonator corresponding to the highest harmonic N would provide a frequency of 100,000 Hz+(N×400 Hz).

These output signals from the microresonators are thus provided along lines 38-0–38-N to multipliers 40-0–40-N where the high frequency signals are mixed with the reference high frequency $f_c$, having a frequency at 100 kHz, in the specific noted example. The reference frequency $f_c$ may be provided by a stable oscillator 18 (shown in FIG. 1) to each of the mixers 40-0–40-N, as well as to the other microresonator output lines activated for other pitches (not shown). The output signal from mixers 40-0–40-N are "beat" signals having a frequency of $f_B$=($f_c$–microresonator frequency) plus some residual higher frequency components. Thus, the beat signals are audio frequency range signals corresponding to the 440 Hz fundamental and harmonics thereof along with the undesired residual high frequency components.

The down converted signals are provided from mixers 40-0–40-N to harmonic synthesis circuitry 20. This circuitry includes low pass filters 42-0–42-N which remove residual high frequency component signals related to mixing the reference frequency $f_c$ and the high frequency components of the microresonator signals. Harmonic synthesis circuitry 20 further includes a gain control stage which may employ voltage controlled amplifiers (VCAs) 44-0–44-N which gain control the audio frequency signals with harmonic weighting coefficients $g_0$–$g_n$. These harmonic weighting coefficients $g_0$–$g_n$ provide varying weights to the harmonic components to create a desired tone color. For example, if a tone color of a piano is selected by the operator, these harmonic weighting coefficients $g_0$–$g_n$ will have a first set of values, whereas if a tone color of an organ is selected these will have different values. The specific values of $g_0$ and $g_n$ are provided by the tone color selection circuitry 22 described below in relation to FIG. 3. Furthermore, these harmonic weighting coefficients may themselves be variable in time. This allows the harmonic content of a given note to vary over the duration of the note. Since the weighting will vary over the duration of the note, this may allow the envelope of the note to be automatically taken account of. Alternatively, harmonic weighting over time may be provided by selectively providing damping control directly to the individual microresonators.

Still referring to FIG. 2, the weighted harmonic components are provided along lines 46-0–46-N to summing circuit 48 which sums the components to create a musical tone signal having the desired tone color. The resulting audio frequency musical tone signal, which may also have a desired waveform variation over time, is provided along line 52.

Figure 3:
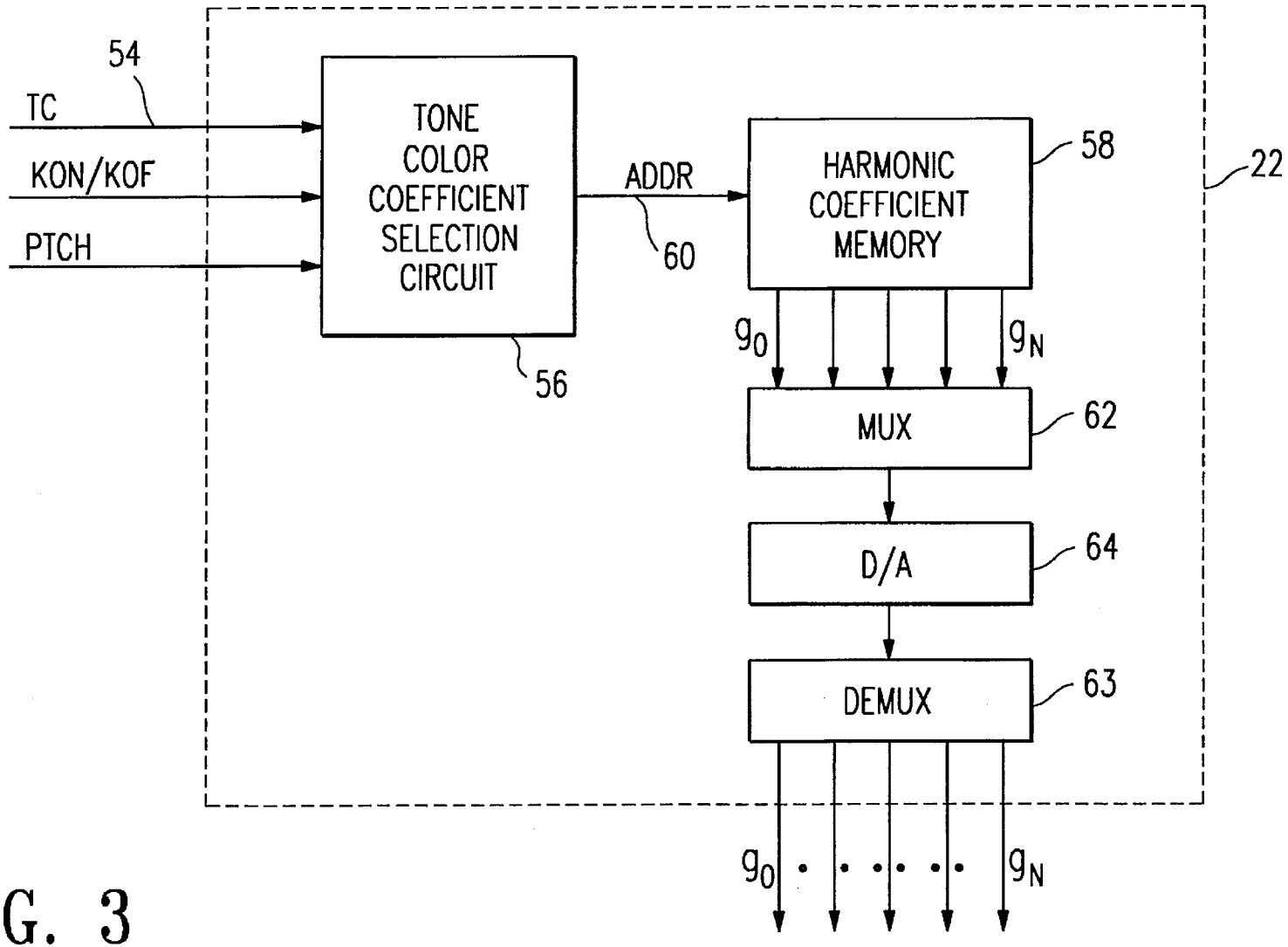
FIG. 3 is a block schematic drawing of a preferred embodiment of a tone color control circuit employed in the musical tone generating apparatus of the present invention.

Referring to FIG. 3, a preferred embodiment of the tone color selection circuit 22 is illustrated. As shown, the tone color selection circuit receives a tone color control signal (TC) along line 54 from a tone color selection lever or a like control which may be configured on the keyboard or otherwise configured so as to be operable by the performer. The tone color selection circuit 22 also receives the pitch designation signal (PTCH) provided from the keyboard 10. Also, the key on (KON) and key off (KOF) signals may be provided to control time variation of the harmonic content if desired. These signals TC and PTCH, and optionally KON and KOF, are provided to a tone color coefficient selection circuit 56 which converts the signals to an address (ADDR) in harmonic weighting coefficient memory 58. Tone color coefficient selection circuit 56 may preferably include a table (e.g. stored in a Read Only Memory-ROM) which associates tone colors and pitch values with specific addresses in harmonic weighting coefficient memory 58 and outputs this address along line 60 to address and readout a specific set of harmonic weighting coefficients. These coefficients are digital equivalents of coefficients $g_0$–$g_n$ discussed above in relation to FIG. 2. These coefficients are read out of memory 58 as digital values $g_0$–$g_n$ and are provided to digital-to-analog (D/A) converter 64 through a multiplexer 62. The digital values are converted to analog weighting values $g_0$–$g_n$ and are provided from D/A converter 64, via demultiplexer 63, to mixers 44-0–44-N, as described above in relation to FIG. 2.

It will be appreciated that by storing a set of additive harmonic weighting values for each desired tone color, e.g. piano, organ, etc., in memory 58 and by preferably associating a different set of coefficient values with each pitch via tone color coefficient selection circuit 56, a varied and rich musical tone may be provided for several different tone colors.

Figure 4:
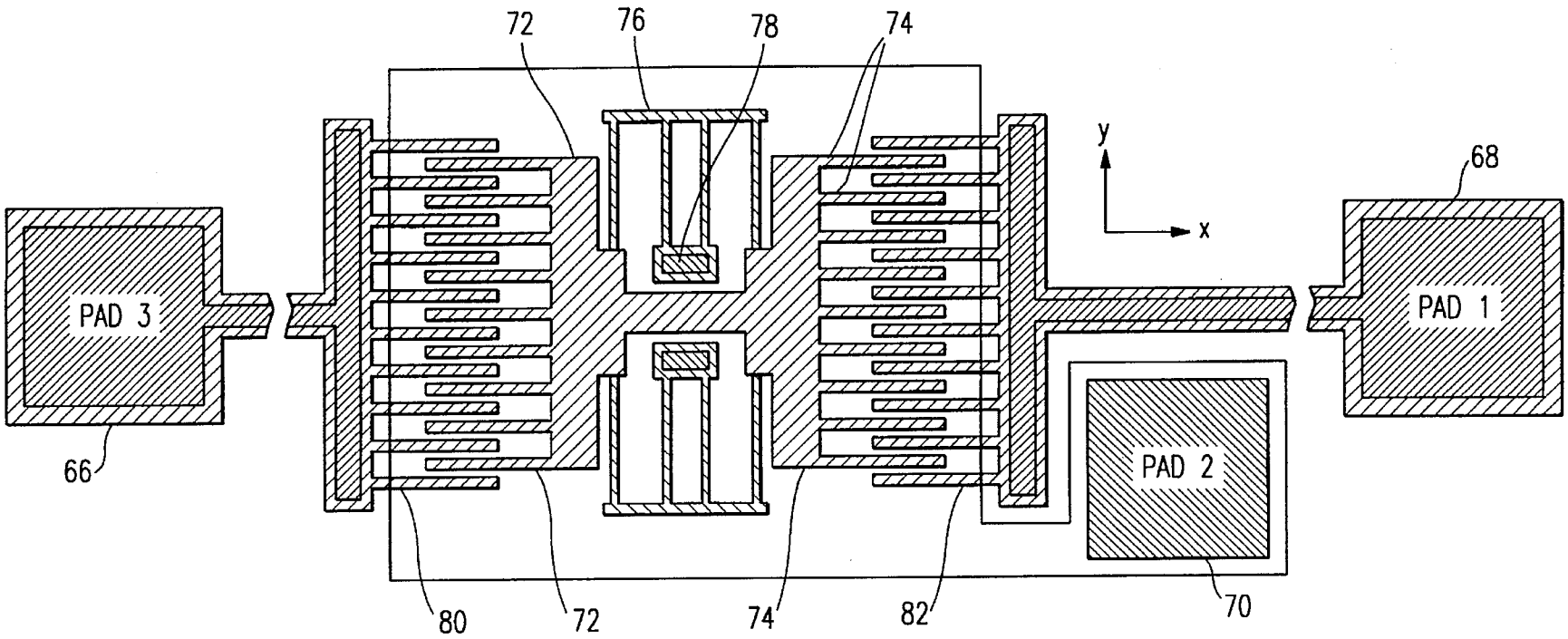
FIG. 4 is a schematic drawing of a microresonator employed in the musical tone generating apparatus of the present invention.
Figure 5:
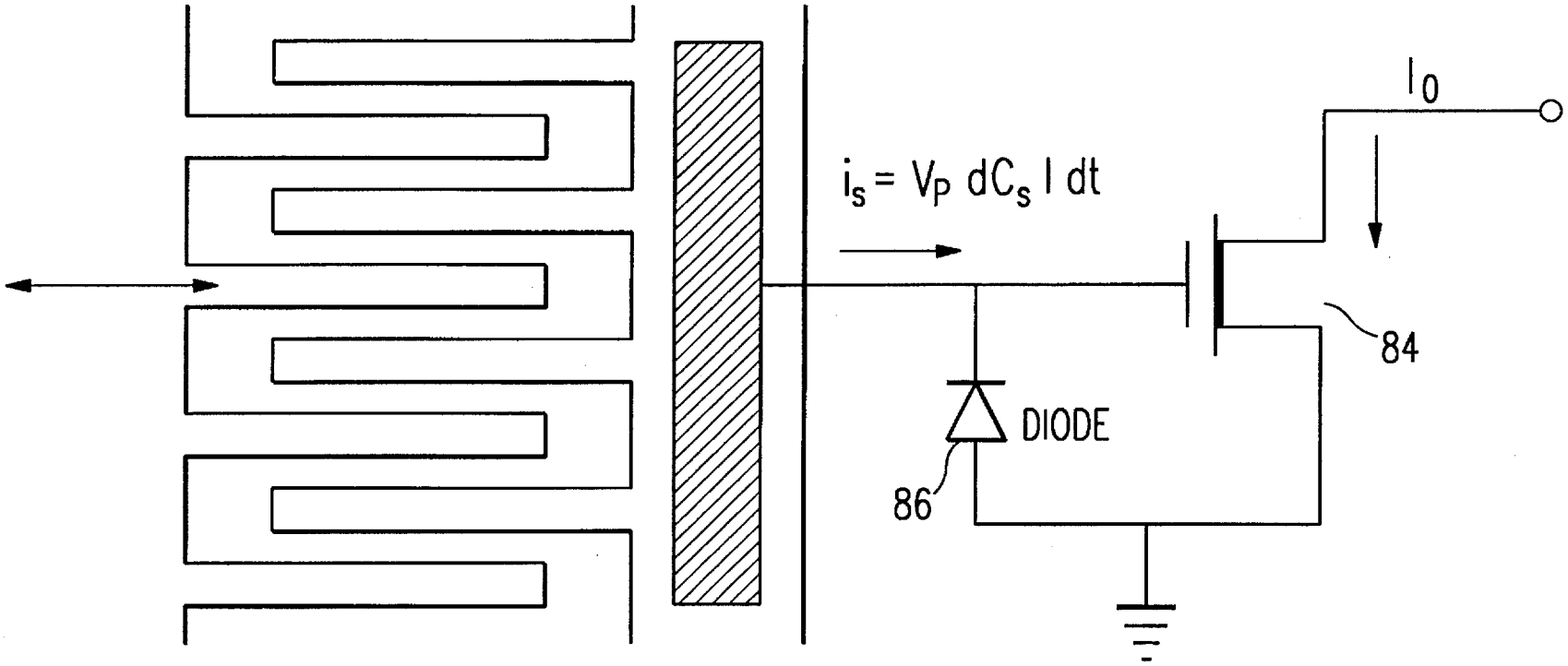
FIG. 5 is a schematic drawing of an output buffer amplifier for use with the microresonator of FIG. 4.

Referring to FIGS. 4 and 5, a preferred embodiment of a microresonator 36 is illustrated. As shown in FIG. 4, the microresonator preferably includes a micromechanical comb-like resonator which is coupled to an output buffer amplifier as illustrated in FIG. 5. It will be appreciated, however, that the specific structure shown is purely illustrative.

Referring to FIG. 4, the microresonator includes input and output pads 66, 68, respectively and a ground plane contact pad 70. The resonant structure itself includes comb fingers 72, 74 suspended by beam 76 on anchor 78. The first set of comb fingers 72 are interdigitated with electrostatic drive fingers 80 which set up an electrostatically driven vibration in the finger 72 when a drive pulse is provided to pad 66 in response to application of a key on (KON) signal to the microresonator selection circuit 30. The vibrations set up in the comb fingers 72 are transmitted to comb fingers 74 which vibrate at a well defined resonant frequency. The vibrations of comb fingers 74, in turn, are capacitively sensed by electrode fingers 82. These sensed signals are provided as an output on pad 68.

The microresonant structure illustrated in FIG. 4 is preferably formed by photolithographic and etching methods from a polysilicon substrate in which a large number of such structures may be integrated. The specific details for the formation of the structure of FIG. 4 are described in U.S. Pat. No. 5,025,346 to Tang, et al., issued Jun. 18, 1991, the disclosure of which is incorporated herein by reference.

Referring to FIG. 5, a buffer amplifier coupled to the output pad 68 of the structure of FIG. 4 is illustrated. The output buffer illustrated in FIG. 5 is employed to prevent a capacitive feedthrough signal through the interdigitated comb fingers in the structure of FIG. 4 from swamping the desired resonant signal. As illustrated, the output buffer amplifier may be a relatively simple structure including an NMOS depletion field effect transistor 84 with its gate coupled to the output pad 68 of the microresonant structure of FIG. 4. A diode 86 coupled between the input pad and ground sets the gate voltage to field effect transistor 84 at 0 volts DC. The output current $I_0$ going through the transistor 84, thus corresponds to a buffered output at the resonant frequency of the resonator structure of FIG. 4.

The resonator illustrated in FIG. 4 has several advantages for providing stable fundamental and harmonic tone signals. In particular, the illustrated microresonator provides a high quality factor (Q) in vacuum (>50,000 @50 kHz); wide frequency range (1 kHz to several MHz); stable frequency; tunable bandwidth; nonlinear characteristics, e.g. through overdrive of the suspension; variable damping through use of bumpers mechanically touching the comb fingers; and ability to integrate the structure in a single chip.

For the above-noted preferred embodiment having a resonant frequency centered around 100 kHz, the suspension beam 76 is chosen to have a length of approximately 60 microns and a width of approximately 2 microns. The length of beam 76 is tuned to provide the desired frequency for each microresonator. For a fifteen finger comb structure, this occupies a total area for a microresonator 36 of approximately 140 square microns. The sense buffer amplifier illustrated in FIG. 5 may also be preferably integrated on the same silicon chip as the microresonator 36, resulting in a total chip area per resonator of approximately 200 square microns. Accordingly, it will be appreciated that a large number of such microresonators may be integrated on a single integrated circuit chip.

In an alternate embodiment, the number of low pass filters and mixers may be reduced by performing the additive synthesis before the mixing. In this case a weighting signal would be provided to the mixer which includes all the harmonics for the desired tone.

In view of the foregoing, it will be appreciated that the musical tone generating apparatus of the present invention provides a compact system capable of providing considerable flexibility in tone production and high quality for more than one tone color. In addition, by combining both digital and analog tone control along with a micromechanical vibrational structure, the present invention overcomes many of the above-noted problems present in electronic musical instruments of both analog and digital type.

While the foregoing is a description of a presently preferred embodiment, it will be appreciated that a wide variety of modifications may be made while remaining within the scope of the present invention. For example, the microresonant structures may be employed to generate musical tone signals in other than the harmonic additive synthesis method described above. For example, the microresonators may be employed to generate a signal rich in harmonics by use of FM analog tone generation techniques. Alternatively, by use of the aforementioned introduction of nonlinearities and/or bumper beams into the microresonant structure illustrated in FIG. 4, a variety of harmonics may be introduced into a single microresonator which can produce complex tones with a relatively small number of microresonators.

Additionally, a variety of different micromachined microresonators may be employed. For example, a variety of mechanical microresonators may be employed including various resonating mechanical beam structures, which may be adjustable in length, e.g. through a slide bar, rotating structures such as wheels or gears, and which may generate vibrations directly or through coupling to other structures such as a reed, piezoelectric vibrating elements, helical or spring shaped vibrating structures, etc. Also, the microresonator may comprise a structure incorporating a fluid medium which is excited and vibrates at resonant frequencies. For example, a simple micromachined chamber including a fluid may be excited through a miniature electrostatically or magnetically driven mechanism, such as a rotating tube, gear type compressor, etc. Also, a turbulent type of excitation may be created via a micromachined reed structure, or like structure, which excitations provide specific resonances via the structure of the chamber. Also, micromachined analog delay structures, which may have tapped delays, may be employed. Additionally, a light modulated micromachined source of high frequency signals could be employed. Accordingly, it will be appreciated that a great many different microresonator designs may be employed while remaining within the scope of the present invention.

Further modifications in the above-noted description of a preferred embodiment will be apparent to those skilled in the art. Accordingly, the present invention should not be viewed as limited to the above-described embodiments but rather such are only illustrated in nature.

What is claimed is:

1. A musical tone generating apparatus, comprising:

pitch designation means, operable by a performer, for providing a pitch designation signal designating a tone pitch of a tone to be generated;

means, responsive to said pitch designation signal, for creating high frequency physical vibrations, said means for creating vibrations including a microresonator structure formed on an integrated circuit chip;

means for converting said physical vibrations to high frequency electrical signals, wherein said vibrations have a frequency substantially higher than the audible frequency range;

means for down converting the high frequency electrical signals to audio frequency range signals based on a reference signal; and means for providing said converted audio frequency range electrical signals as musical tone generation signals.

2. A musical tone generating apparatus as set out in claim 1, further comprising tone color designation means for designating a desired tone color in response to a selection operation by the performer.

3. A musical tone generating apparatus as set out in claim 1, wherein a separate microresonator is provided for each pitch designated by said pitch designation means.

4. A musical tone generating apparatus as set out in claim 1, wherein said means for creating vibrations comprises a plurality of microresonators corresponding to plural harmonics of said tone and wherein said tone color designation means controls a relative weighting of the microresonator outputs.

5. A musical tone generating apparatus as set out in claim 1, wherein said high frequency vibrations are approximately 100 kHz.

6. A musical tone generating apparatus as set out in claim 1, wherein said means for down converting the frequency of said electrical signals to the audio frequency range comprises means for mixing a high frequency reference signal with said high frequency electrical signals.

7. A musical tone generating apparatus as set out in claim 2, wherein said tone color designation means comprises a digital circuit including a harmonic component memory and means for addressing said harmonic component memory in response to a tone color selection.

8. A musical tone generating apparatus as set out in claim 1, wherein said microresonator is an electrostatically driven mechanical microresonator fabricated on a polysilicon substrate.

9. A musical tone generating apparatus as set out in claim 1, further comprising means for low pass filtering the down converted electrical signals prior to providing said down converted signals as musical tone generation signals.

10. A musical tone generating apparatus as set out in claim 4, wherein said relative weighting is varied through the duration of a note.

11. A musical tone generating apparatus, comprising:

manual performance input means for providing a tone pitch control signal;

tone generation means, responsive to said tone pitch control signal, for providing a musical tone generation signal, comprising:

a plurality of microresonators integrally formed on a substrate;

means for selectively activating a predetermined number of said plurality of microresonators in response to said tone pitch control signal, wherein said microresonators provide output signals having frequencies substantially higher than the audible frequency range;

means for combining the output signals from said selected microresonators with harmonic weighting signals; and means for shifting the frequency of the output signals from said microresonators to an audio frequency range based on a reference signal; and tone generation output means for receiving the shifted audio frequency range output signals from said tone generation means and providing them as a musical tone output signal.

12. A tone generating apparatus as set out in claim 11 further comprising tone color control circuitry for receiving a tone color selection signal and outputting said harmonic weighting signals in response thereto.

13. A musical tone generating apparatus as set out in claim 12, wherein said tone color control circuitry comprises:

a digital memory for storing a plurality of harmonic weighting coefficients;

a tone color coefficient selection circuit for receiving said tone color selection signal and converting said tone color selection signal to an address in said harmonic weighting coefficient memory;

means for outputting harmonic weighting coefficients at said address in said harmonic weighting coefficient memory as digital harmonic weighting coefficient signals; and means for converting said digital harmonic weighting coefficient signals to analog harmonic weighting signals.

14. A musical tone generating apparatus as set out in claim 12, wherein said harmonic weighting signals are time varying.

15. A method for generating a musical tone signal, comprising the steps of:

providing a tone initiation signal in response to activation of a manual performance interface by a performer;

creating physical vibrations in a micromachined structure in response to said tone initiation signal;

converting said physical vibrations to high frequency electrical signals having a frequency substantially higher than the audible frequency range;

converting the high frequency electrical signals to audio frequency electrical signals; and providing said audio frequency electrical signals as a musical tone signal.

16. A method as set out in claim 15, further comprising the step of mixing said electrical signals with a reference signal to convert the frequency of said electrical signals to the audio frequency range.

17. A method as set out in claim 15, wherein said step of creating physical vibrations comprises exciting vibrations in a mechanical structure through capacitive coupling to an electrical excitation signal.

18. A method as set out in claim 15, wherein said step of creating physical vibrations comprises exciting plural micromachined structures simultaneously.

19. A method as set out in claim 15, further comprising the step of providing a tone pitch designation signal, and wherein said step of creating physical vibrations comprises creating vibrations corresponding to the designated pitch.

* * * * *